US007668496B2

(12) United States Patent
Tamemasa et al.

(10) Patent No.: US 7,668,496 B2
(45) Date of Patent: Feb. 23, 2010

(54) LAMINATED BODY, ENDLESS BELT, FIXING DEVICE AND IMAGE FORMING APPARATUS

(75) Inventors: Hiroshi Tamemasa, Kanagawa (JP); Motofumi Baba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 274 days.

(21) Appl. No.: 11/806,056

(22) Filed: May 29, 2007

(65) Prior Publication Data

US 2008/0152402 A1 Jun. 26, 2008

(30) Foreign Application Priority Data

Dec. 25, 2006 (JP) ..... 2006-348471

(51) Int. Cl.
*G03G 15/20* (2006.01)

(52) U.S. Cl. ..... 399/329; 399/333

(58) Field of Classification Search ..... 399/328, 399/329, 333; 430/124.1, 124.3, 124.32, 430/124.38

See application file for complete search history.

(56) References Cited

U.S. PATENT DOCUMENTS

| | | | | |
|---|---|---|---|---|
| 7,483,666 | B2 * | 1/2009 | Tatematsu et al. | 399/329 |
| 2004/0105708 | A1 * | 6/2004 | Imai et al. | 399/333 X |

FOREIGN PATENT DOCUMENTS

| | | |
|---|---|---|
| JP | B2 05-009027 | 2/1993 |
| JP | A 07-114276 | 5/1995 |
| JP | A 2003-131507 | 5/2003 |
| JP | A 2005-345997 | 12/2005 |
| JP | A 2006-011144 | 1/2006 |
| JP | A 2006-011217 | 1/2006 |
| JP | A 2006-064917 | 3/2006 |
| JP | A 2006-078809 | 3/2006 |
| JP | A 2006-079949 | 3/2006 |

* cited by examiner

*Primary Examiner*—Sandra L Brase
(74) *Attorney, Agent, or Firm*—Oliff & Berridge, PLC

(57) ABSTRACT

There is provided a laminated body including a heat generation layer that includes crystalline particles of a non-magnetic metal; and a base layer that includes a magnetic shunt alloy. There are also provided an endless belt, a fixing device and an image forming apparatus using the laminated body.

19 Claims, 4 Drawing Sheets

LAMINATED BODY, ENDLESS BELT, FIXING DEVICE AND IMAGE FORMING APPARATUS

CROSS-REFERENCE TO RELATED APPLICATIONS

This application is based on and claims priority under 35 USC 119 from Japanese Patent Application No. 2006-348471 filed Dec. 25, 2006.

BACKGROUND

1. Technical Field

The present invention relates to a laminated body, an endless belt, a fixing device, and an image forming apparatus.

2. Related Art

For electrophotographic image forming apparatuses using dry toner, in a fixing device for fixing a toner image to a recording medium surface by applying heat and pressure, conventionally, a toner release layer is provide on the external peripheral surface of a metal core, at an inside portion of the metal core, a fixing roll is used with a halogen heater for applying heat.

In a fixing device and image forming apparatus using an endless belt, the endless belt may be disposed within limited space by bending the endless belt around with a high degree of curvature. Also, when an endless belt is used as a fixing belt, by having a high degree of curvature, the recording medium transported into the contact portion, formed between the endless belt and the pressure applying member pressing the endless belt, may be easily released from the endless belt.

SUMMARY

According to an aspect of the present invention, there is provided a laminated body comprising:

a heat generation layer that includes crystalline particles of a non-magnetic metal; and a base layer that includes a magnetic shunt alloy.

BRIEF DESCRIPTION OF THE DRAWINGS

Exemplary embodiments of the present invention will be described in detail based on the following figures, wherein.

DETAILED DESCRIPTION

Details of the present invention will now be explained.

<Laminated Body>

The laminated body of an aspect of the present invention includes at least: a heat generation layer that includes crystalline particles of a non-magnetic metal; and a base layer that includes a magnetic shunt alloy.

The configuration of the laminated body of an aspect of the present invention will now be explained.

Figure 1:
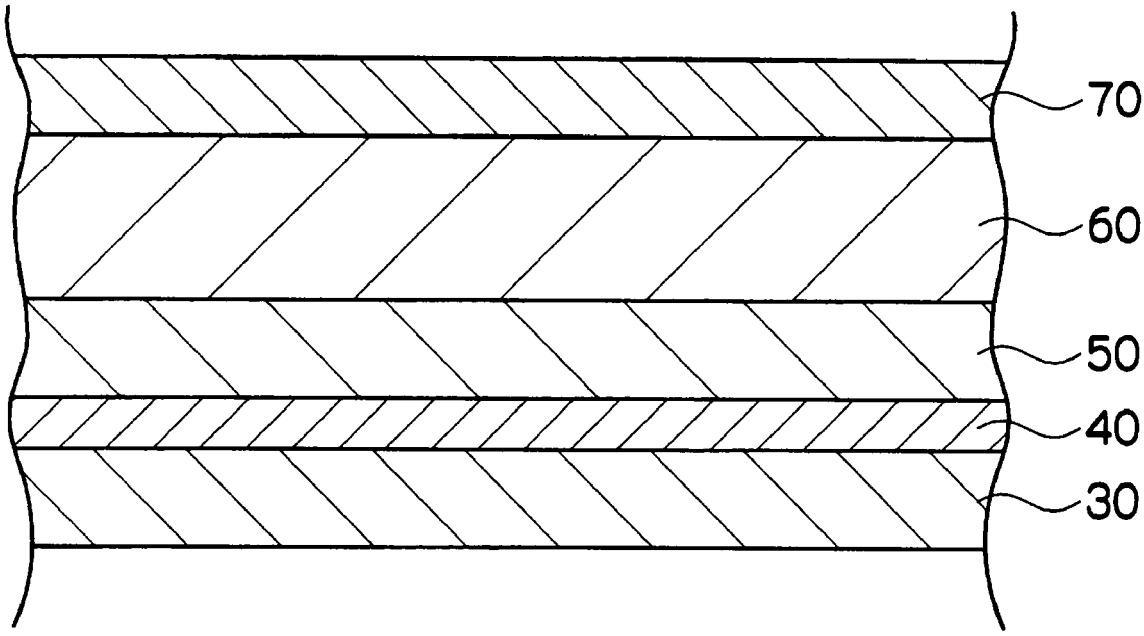
FIG. 1 is a cross-section pattern diagram showing one example of a laminated body according to an aspect of the present invention.

FIG. 1 is a cross-section pattern diagram showing one example of a laminated body according to an aspect of the present invention, and shows a laminated body configured with 5 layers. The laminated body is a 5 layer configuration with a base layer 30, a heat generation layer 40, a protective layer 50, an elastic layer 60, and a resin layer 70 provided in that order from the bottom of FIG. 1. FIG. 1 simply shows one example of a configuration of an aspect of the present invention, and embodiments may also be formed in which there is no protective layer 50, elastic layer 60 and/or resin layer 70.

(Heat Generation Layer)

The heat generation layer 40 formed on one side of the base layer 30 is a layer that generates heat by causing an overcurrent to occur due to electromagnetic induction. The heat generation layer 40 includes a non-magnetic metal (in the present invention, the non-magnetic metal included in the heat generation layer is also sometimes referred to as the "first non-magnetic metal") and also includes crystalline particles of the first non-magnetic metal, and the presence or not of crystalline particles may be confirmed by examining the crystalline structure of the heat generation layer 40 in a cross-section of the final laminated body, using an optical microscope or an electron microscope (for example a scanning electron microscope (SEM)).

Here, when the above heat generation layer is a layer formed using plastic deformation, crystalline particles may be confirmed from the cross-section, and crystals of metal are aligned along the surface direction (the direction orthogonal to the thickness direction). More specifically, the crystals of metal are aligned elongated along the surface direction by plastic deformation. In contrast, for example, in a layer formed by plating, in cross-section crystals of metal are aligned in the thickness direction (the direction parallel to the thickness direction), and such a difference may be confirmed by the above observations. In the above explanation the meaning of surface direction is a direction that is at an angle of 0° or above, but less than 45°, to the metal substrate plane (the surface of the base layer 30), and the meaning of thickness direction is a direction that is at an angle of 45° to 90° to the metal substrate plane.

Furthermore, with regard to other metal layers other than the above heat generation layer (the base layer containing a magnetic shunt alloy, and later described protective layer, and the like), when there are layers formed using plastic deformation, alignment of metal crystals in the surface direction may be confirmed by checking the crystal particles in cross-section.

Regarding the material of the heat generation layer 40 there are no particular limitations other than the inclusion of the non-magnetic metal (first non-magnetic metal), and materials may be selected according to the application of the laminated body. However, it is preferable that the material used has, as the layer, a resistivity value of $2.8\times10^{-6}$ Ωm or below. The above resistivity value is more preferably between $1.0\times10^{-6}$ Ωm and $2.5\times10^{-6}$ Ωm, and is particularly preferably between $1.2\times10^{-6}$ Ωm and $2.2\times10^{-6}$ Ωm.

The above resistivity values may be measured by the following method.

The measurement of resistivity value may follow the standard procedures set out in JIS-C2525 (1999) "Test methods for determining conductor resistance and volume resistivity of metallic resistance materials", the disclosure of which is incorporated by reference herein, using a resistivity measurement instrument (SIGMA-5) manufactured by NPS Inc., mounting the sample to be measured on the test stage of the measurement instrument, and measuring the resistivity of the sample using a direct current and a 4-point probe method by pressing a 4 point probe against the sample.

The resistivity values in this specification are values determined by the above measurement method. Measurement of the resistivity value of layers other than the heat generation layer 40 may also be made by the above method.

Examples that may be given of metallic materials favorably used for the non-magnetic metal (first non-magnetic metal) include metallic materials including at least one metal chosen from gold, silver, copper, aluminum, zinc, tin, lead, bismuth, beryllium, antimony, and alloys thereof (including alloys containing these metals). Amongst these, gold, silver, copper, aluminum, and alloys thereof are particularly preferable. By using such non-magnetic metals, the above resistivity value may easily be made to achieve the above ranges, and each may be favorably applied as the non-magnetic metal of the heat generation layer 40.

It is preferable to make the layer thickness of the heat generation layer 40 between 5 and 20 μm, more preferable is between 7 and 15 μm, and particularly preferable is between 8 and 12 μm.

The above layer thickness may be calculated according to the following method.

The layer thickness may be determined by observing a cross-section of the laminated body using an optical or an electron microscope (for example a scanning electron microscope (SEM), and in the present application a T-200, manufactured by JEOL Ltd., is used), and deriving an average value from the layer thickness measurements of 36 locations on a single heat generation layer (particularly in the case of an endless belt, 4 locations×9 locations is used, giving a total of 36 locations).

In the present specification, the values of layer thickness for each of the layers are values that are computed by the above calculation method.

(Base Layer)

There is a base layer 30 including a magnetic shunt alloy provided on one side of the heat generation layer 40.

Here, magnetic shunt alloy refers to metal materials that have a Curie point. Curie point is also called Curie temperature, and means the temperature equal to or above which magnetism is lost, the temperature of becoming non-magnetic (paramagnetic body). That is to say, the magnetic shunt alloy indicates a magnetic metal material whose magnetic properties may be changed by changing the temperature of the metal.

The Curie point in an aspect of the present invention indicates a temperature at which, along with a rise in temperature of the material, there starts to be a rapid reduction in the initial permeability, and is the temperature at which the effect of an aspect of the invention may start to be obtained.

As a specific measurement method, measurements of magnetic permeability may be undertaken using the method set out in the standard procedures according to JIS-C2531 (using a B-H analyzer as the measurement device) and processing to obtain the B-H curve, with the Curie temperature being the intersection between the linear approximation of the slope where the magnetic permeability rapidly decreases, and the linear approximation to the change in magnetic permeability before the Curie point where magnetism is lost. The disclosure of JIS-C2531 is incorporated by reference herein.

As stated above, when the magnetic shunt alloy reaches the Curie point or higher, the magnetic shunt alloy becomes non magnetic. By a magnetic body with a relative magnetic permeability of at least several hundred becoming non magnetic (paramagnetic), the relative magnetic impermeability approaches 1, and since a change in the magnetic flux density occurs (strengthening/weakening of the magnetic field), the magnetic flux density is weakened by becoming non magnetic and a change can be imparted that makes it difficult to generate heat.

It is preferable to use for the base layer 30 a "non heat generation body" that is made not to generate heat due to the action of a magnetic field. If the heat generation of the non heat generation body is large then, when heat is applied to the heat generation layer 40 by the electromagnetic induction effect on the heat generation layer, at the same time magnetic flux also acts on the non heat generation body due to the electromagnetic induction, therefore, if the self generated heat due to overcurrent loss or hysteresis loss is great then the temperature rises, and unintentionally the temperature may reach the Curie temperature or higher, giving a temperature suppressing effect when it is not required. Since the base layer 30 is a member necessary in order to suppress the temperature of the laminated body, it is necessary to make unintentional temperature rises due to self generated heat as small as possible, and the base layer 30 according to the present embodiment may be a member with sufficiently small self generated heat relative to the generated heat of the heat generation layer 40.

There are no particular limitations to the material of the base layer 30, as long as a magnetic shunt alloy is used, and the material may be selected according to the application of the laminated body. There may be used a magnetic shunt alloy with a Curie point that is higher than the setting temperature when used in a later described fixing device, or higher than the required temperature of use when used in other applications. Furthermore, there may be used a magnetic shunt alloy that has a Curie point that is not higher than the temperature that may be withstood by the laminated body. For example, when the laminated body is used in the above fixing device, a Curie point of between 170 and 250° C. is preferable, with a Curie point between 200 and 230° C. being more preferable.

Metal materials with high mechanical strength may be used for the magnetic shunt alloy, and specific examples include at least one metal material chosen from iron, nickel, chromium, cobalt, molybdenum, manganese, vanadium and alloys thereof (including alloys containing these metals). Since, by use of such magnetic shunt alloy, it is easy to obtain a Curie point achieving the above ranges, each of these may be favorably used as the magnetic shunt alloy for use in the base layer 30.

It is preferable to make the layer thickness of the base layer 30 between 5 and 100 μm, and more preferable is between 10 and 70 μm, with the layer thickness of the base layer 30 being calculated according to the same computational method as for the heat generation layer 40 above.

It is preferable that the base layer 30, as a layer, has a resistivity value higher than $2.8\times10^{-6}$ Ωm. The above resistivity value is more preferably between $5.0\times10^{-6}$ Ωm and $5.0\times10^{-5}$ Ωm, and is particularly preferably between $7.0\times10^{-6}$ Ωm and $3.0\times10^{-5}$ Ωm. The resistivity of the base layer 30 may be measured according to the same measurement method as used for the heat generation layer 40 above.

(Protective Layer)

In the laminated body a protective layer 50 may be formed on the side of the heat generation layer 40 of FIG. 1 that is on the opposite side to that on which the base layer 30 is provided. The protective layer 50 may include a non magnetic metal (sometimes in an aspect of the invention the non magnetic metal included in the protective layer is referred to as a "second non magnetic metal") that is different from the non magnetic metal used in the heat generation layer 40.

There are no particular limitations to the material of the protective layer 50, and the material may be selected according to the application of the laminated body, however, it is preferable that, as a layer, the material has a resistivity value higher than $2.8\times10^{-6}$ Ωm. The above resistivity value is more preferably between $5.0\times10^{-6}$ Ωm and $5.0\times10^{-5}$ Ωm, and is particularly preferably between $7.0\times10^{-6}$ Ωm and $3.0\times10^{-5}$ Ωm. The resistivity of the protective layer 50 may be measured according to the same measurement method as used for the heat generation layer 40 above.

Examples which may be given of metal material that may be used favorably as the non magnetic metal (second non magnetic metal) used in the protective layer 50 are at least one metal material selected from stainless steel and stainless steel alloys (including alloys including stainless steel). By using such non magnetic metals it is easy to obtain a resistivity within the above ranges, and therefore each of the above may be favorably used as the non magnetic metal in the protective layer 50.

It is preferable to make the layer thickness of the protective layer 50 between 5 and 100 μm, and more preferable is between 10 and 70 μm. The layer thickness of the protective layer 50 may be calculated according to the same computational method as for the heat generation layer 40 above.

(Formation of the Base Layer, Heat Generation Layer and Protective Layer)

There are no particular limitations to the formation of the base layer 30, heat generation layer 40, and protective layer 50, and they may be shaped as a plate, sheet, film, cylinder or the like. As a method for forming each of the layers, first a metal plate of the metal required for each of the layers may be prepared, then the contact surfaces of each of the metal plates may be polished and any oxidized coating thereon removed. Then, each of the metal plates may be bonded together using a working (rolling) method by plastic deformation either by cold rolling or hot rolling, producing a multi-layered metal plate of the desired thickness. By providing an annealing process in the plastic deformation processing or after the plastic deformation processing, stress in the metal plates generated by working may be reduced. Next, the laminated body of the base layer 30, heat generation layer 40 and protective layer 50 may be obtained by processing the multi-layered metal plate with a deep drawing method, a spinning method, a press method, a rotary forming method or the like. When forming a laminated body of the base layer 30 and the heat generation layer 40, the same methods as the above may be applied to metal plates of the necessary metal for the base layer 30 and the heat generation layer 40.

A laminated body with the thickness of the heat generation layer 40 controlled to the above preferably range of 5 to 20 μm may be obtained by plastic deformation processing of a multi-layered metal plate of two or more layers including the base layer 30 and the heat generation layer 40, and applying the above forming methods.

Furthermore, when forming the laminated body, the neutral axis may be located within the heat generation layer 40 so that when bending deformation occurs, there is no stress generated therein. When bending deformation is generated in the laminated body, there is compressive stress generated at the inside of the arc of the bending deformation, whereas tensile stress is generated at the outside of the arc of the bending deformation, however, there is a neutral axis that exists at a neutral plane in the thickness direction of the laminated body, where the sum of the above tensile stress and compressive stress is zero (in other words a plane where there is no stress generated).

In order to form a laminated body with the above neutral axis in the heat generation layer 40, this may be achieved, for example when there is a protective layer 50 and a base layer 30 present, by forming the protective layer 50 and the base layer 30 such that the layer thicknesses thereof are the same as each other.

(Elastic Layer)

An elastic layer 60 may be provided on the surface of the protective layer 50 (or, in the case when there is no protective layer 50, on the surface of the heat generation layer 40). The elastic layer 60 is not particularly limited and may be selected according to the application of the laminated body. The elastic layer may be, for example, a heat resistant elastic layer of silicone rubber or fluoro rubber. The elastic layer is a layer of a material that will deform under the application of an external pressure of 100 Pa, and then return to its original shape.

Examples that may be given of silicone rubbers include vinyl methyl silicone rubber, methyl silicone rubber, phenyl methyl silicone rubber, fluoro silicone rubber and composite materials thereof. Furthermore, the following may be used as fluoro rubbers: fluoro vinylidene based rubbers, tetrafluoroethylene/propylene based rubbers, tetrafluoroethylene/ perfluoro(methylvinylether) rubber, phosphazene based rubbers, fluoropolyether and like fluoro rubbers. These may be used singly or may be used in combinations of two or more.

The layer thickness of the elastic layer 60 is preferably within the range of 30 to 500 μm, and more preferably within the range of 100 to 300 μm.

The hardness of the elastic layer 60 may be within the range of A5 to A40, as a durometer hardness Type-A, tested according to the durometer hardness test as set out in JIS-K6253 (1997), the disclosure of which is incorporated by reference herein. The hardness of the elastic layer 60 may be measured by cutting out and testing a portion of the elastic layer 60 from the laminated body.

Methods that may be applied for forming the elastic layer 60 included such methods as ring coating methods, dip coating methods, and injection molding methods.

(Resin Layer)

A resin layer 70 may be provided on the surface of the elastic layer 60 (or if there is no elastic layer 60 then on the surface of the protective layer 50, and furthermore if there is no protective layer 50 then on the surface of the heat generation layer 40). There are no particular limitations to the resin layer 70, and it may be selected according to the application of the laminated body, however, the resin layer may be constituted from, for example, an inorganic material, an organic material, or a composite material thereof.

The resin layer 70 may be a layer that is superior in heat resistance (i.e. substantially does not breakdown at 300° C.) and has superior releasing properties, and the resin layer may be a layer of, for example, one or more resin selected from a fluoro resin, a silicone resin, a polyimide resin, a polyamide resin, or a polyamideimide resin.

Examples that may be given of fluoro resins that may be used include PFA (tetrafluoroethylene-perfluoroalkylvinylether copolymer) PTFE (polytetrafluoroethylene), FEP (tetrafluoroethylene-hexafluoropropylene copolymer) and composite materials thereof. Examples that may be given of silicone resins that may be used include dimethylsilicone resin, dimethylethylsilicone resin, diethylsilicone resin, diphenylsilicone resin, dimethylphenylsilicone resin, diethylphenylsilicone resin and composite materials thereof. These may be used singly or in combinations of two or more.

Examples of polyimide resins which may be used include products obtained from reacting equal molar quantities of tetracarboxylic dianhydride with a diamine compound. An aromatic tetracarboxylic dianhydride may be used as the tetracarboxylic dianhydride and an aromatic diamine may be used as the diamine.

The layer thickness of the resin layer 70 is preferably within the range from 10 to 200 μm, and more preferably from 30 to 100 μm. Electrostatic powder coating methods, spray coating methods, dip coating methods and centrifugal coating methods may be applied as a method for forming the resin layer 70.

Additives, such as lubricants, plastisizers, conductive particles, antioxidants and the like, may be included as required in the resin layer and elastic layer constructed from the above described materials. Such additives may be added in advance to the coating liquids for forming each of the above layers.

Uses for the laminated body of the above described exemplary embodiment are not particularly limited as long they are applications with a laminated body including basically at least the base layer and the heat generation layer, for example, a laminated body including the base layer and the heat generation layer and further including the protection layer, the resin layer and/or the elastic layer. However, in particular, it may be effectively used in applications in which it is required that the thermal capacity does not increase and there are repeated heating and cooling cycles.

Also, the laminated body may, for example, be favorably applied as an intermediate transfer member, such as of a roll or belt form, a fixing member or a pressing member, in image forming devices typified by the likes of printers and copiers. Furthermore, the laminated body may be favorably used in a laminating process where plural sheets are heated and pressure bonded.

<Endless Belt>

The endless belt of an aspect of the present invention is a belt formed using the above laminated body of an aspect of the present invention formed into an endless shape, and may be favorably applied as an intermediate transfer belt, fixing belt, or pressing belt, in an image forming apparatus that forms an image from toner, such as a printer or copier.

Figure 2:
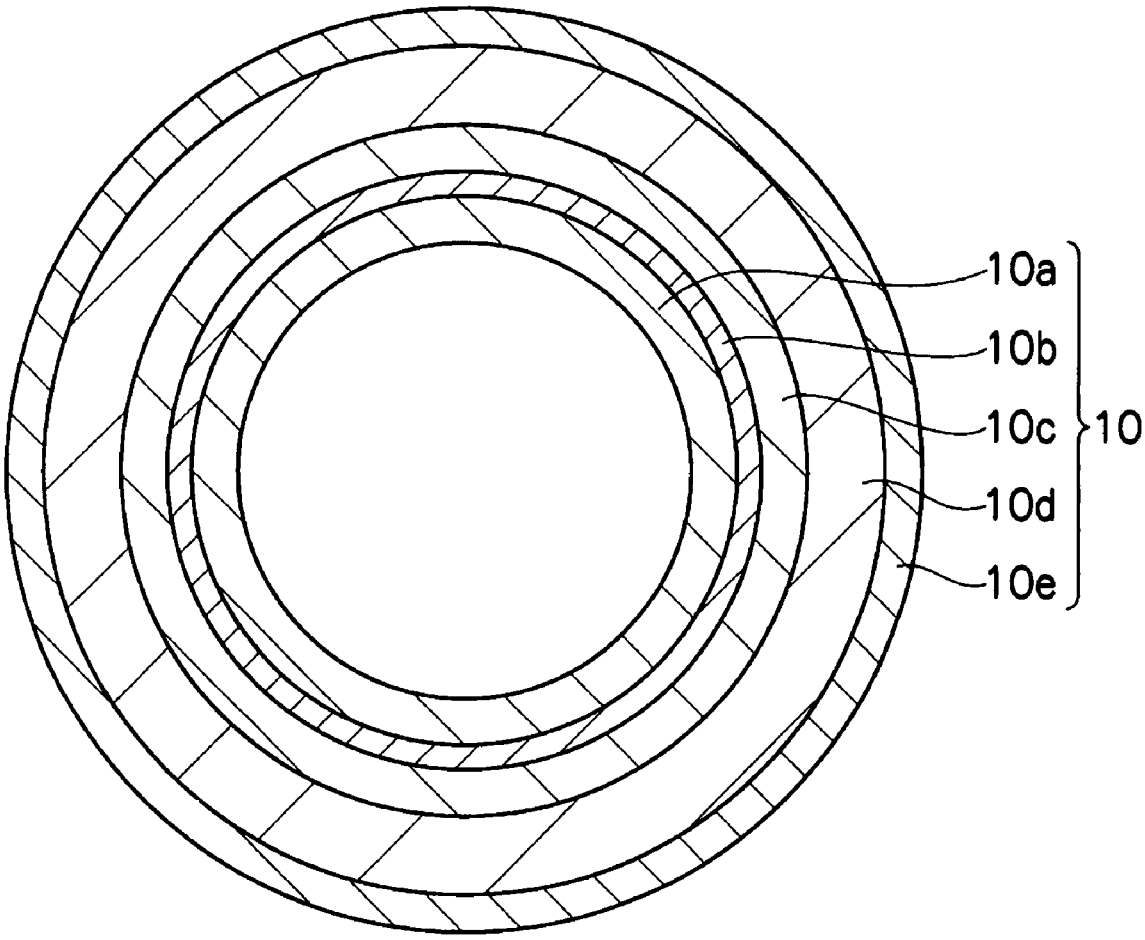
FIG. 2 is a cross-section pattern diagram showing one example of a configuration of a fixing belt of an aspect of the present invention.

FIG. 2 is a cross-section pattern diagram showing one example of a configuration of a fixing belt of an aspect of the present invention, and shows an example of an endless belt of a 5 layer construction.

The endless belt 10 of FIG. 2 is configured with a base layer 10*a*, a heat generation layer 10*b*, a protective layer 10*c*, an elastic layer 10*d*, and a resin layer 10*e*, provided in that order from the inner peripheral side.

The constituting materials and formation methods of each of the layers are as per the contents of the explanation for the laminated body.

In the endless belt according to the present exemplary embodiment also, in order to obtain the high strength base layer 10*a* and the heat generation layer 10*b* (and also the protective layer 10*c* when forming the protective layer 10*c*), it goes without saying that metal base plates may be formed using a plastic deformation method the endless belt 10 may be formed as a laminated body having the preferred layer thickness of heat generation layer 10*b*.

<Fixing Device>

Next, explanation will be given below of a fixing device using the endless belt of an aspect of the present invention.

The fixing device of an aspect of the present invention is provided with at least: an endless belt (fixing belt) of an aspect of the present invention, including the heat generation layer; a pressing member that presses the external peripheral face of the endless belt; and a heat generation member that causes generation of an overcurrent in the heat generation layer.

There are no particular limitations to the fixing device of an aspect of the present invention as long as, as explained above, it is provided with at least the fixing belt, the pressing member, and the heat generation member. However, as the need arises, a cleaning member such as a metal blade and other components and devices such as a fixing pad, may also be provided. Furthermore, the shape of the pressing member is not particularly limited as long as it is rotatable, and a roll shape or a belt shape are both suitable.

Next, explanation will be given of a particular example of a fixing device of an aspect of the present invention with reference to the accompanying figures. However, the heat fixing device using the endless belt of an aspect of the present invention is not limited to the configuration explained and shown below.

Figure 3:
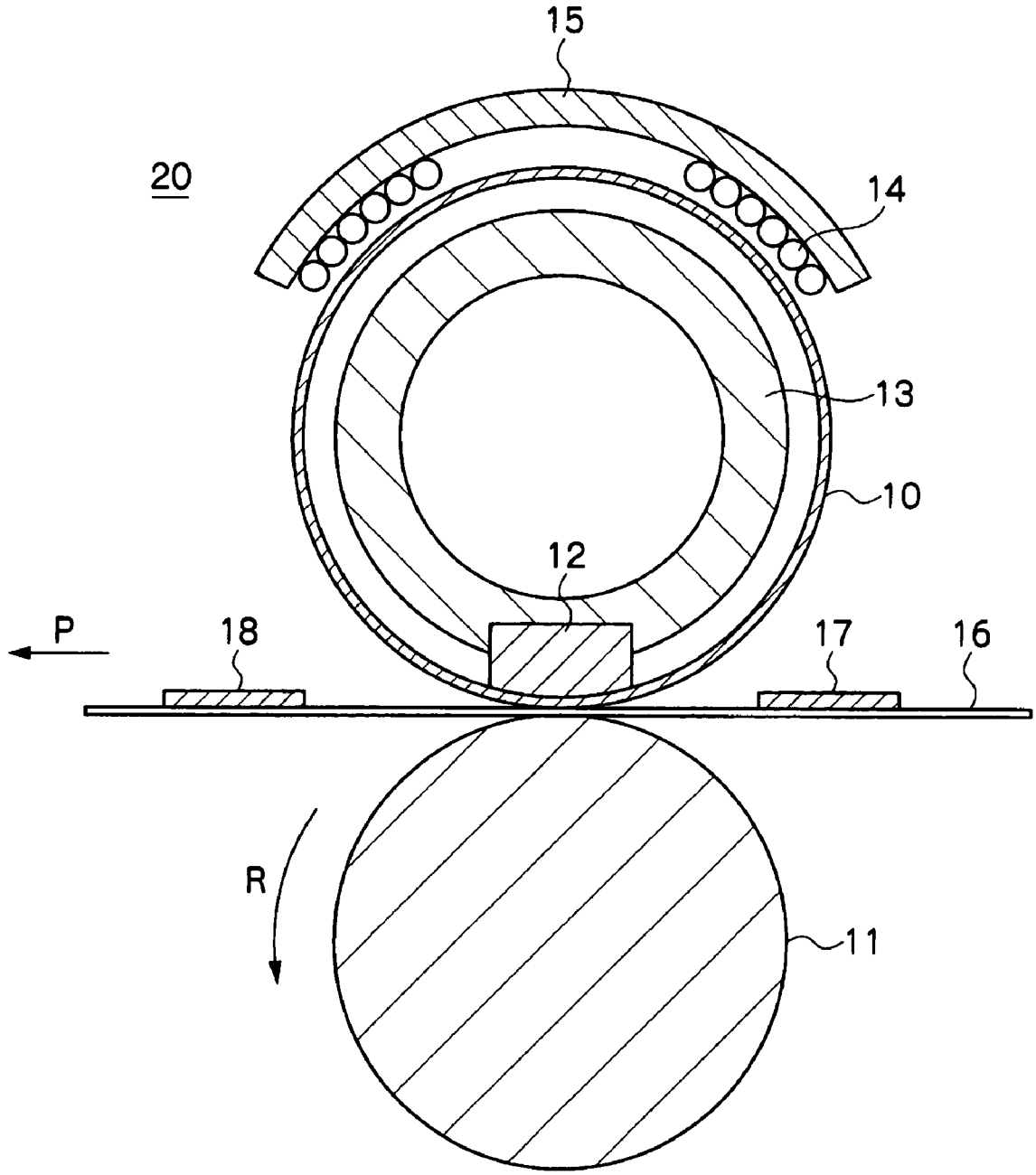
FIG. 3 is a cross-section pattern diagram showing one example of a configuration of a fixing device of an aspect of the present invention.

FIG. 3 is a pattern cross-section diagram showing an example of a configuration of a fixing device of an aspect of the present invention. A fixing device 20 includes a fixing belt 10, a pressing roller 11, a fixing pad 12, a supporting member 13, an electromagnetic induction coil 14, and a coil supporting member 15.

The pressing roller 11 is rotatable in the direction of arrow R by a non illustrated drive source. The fixing belt 10 and the pressing roller 11 are in pressing contact together such that a recording medium 16 may be inserted therebetween, and the fixing belt 10 may be driven, by the rotation of the pressing roller 11 in the direction of the arrow R. A press contact portion is formed, such that the recording medium 16 may be inserted thereto, by the fixing pad 12 being disposed on the inner peripheral side of, and in contact with the inner peripheral surface of, the fixing belt 10, and the pressing roller 11 being disposed so as to be in contact at the external peripheral face side (the external peripheral surface of the fixing belt 10) at the location at which the fixing pad 12 is in contact. The fixing pad 12 is held fixed to the supporting member 13 provided at the inner peripheral surface of the fixing belt 10.

The electromagnetic induction coil 14, serving as a heat generation member, is provided relative to the supporting member 13, separated by a specific interval from the external peripheral surface of the fixing belt 10 at the side of the external peripheral surface of the fixing belt 10 that is opposite to the side of the fixing pad 12. The electromagnetic induction coil 14 is held fixed to the coil supporting member 15, provided on the opposite side of electromagnetic induction coil 14 to that of the external peripheral surface of the fixing belt 10. The electromagnetic induction coil 14 is connected to a non illustrated power source, and when an alternating current flows through the electromagnetic induction coil 14 a magnetic field may be generated, by the electromagnetic induction coil 14, which intersects (for example is orthogonal to) the external peripheral surface of the fixing belt 10. The magnetic field is such that, by using a non illustrated excitation circuit, the direction of the magnetic field may be varied, so that an overcurrent may be generated in the heat generation layer included in the fixing belt 10.

Next, explanation will be given of a process for fixing an unfixed toner image 17 formed on the surface of the recording medium 16, and forming an image 18 on the surface of the recording medium 16.

The fixing belt 10 is driven by the rotation of the pressing roller 11 in the direction of the arrow R, and exposed to the magnetic field generated by the electromagnetic induction coil 14. At this time an overcurrent in the heat generation layer in the fixing belt 10 is generated by the electromagnetic induction coil 14, and heat is generated. Due to this, the external peripheral surface of the fixing belt 10 is heated up to a temperature at which it is possible to carry out fixing (about 150 to 200° C.). The power output of the electromagnetic induction coil 14 is within a range so that, for example, magnetic flux (magnetic field) passes through the heat generation layer 10*b* of the fixing belt 10 and causes heat to be generated, but at less than the Curie point the magnetic flux (magnetic field) finds it difficult to pass through the base layer 10*a* and does not generate heat in the base layer 10*a*.

By the above method a specific region of the external peripheral surface of the fixing belt 10 is heated, and the heated region, along with the rotation of the fixing belt 10, moves to the press contact portion with the pressing roller 11. Also, the recording medium 16, with the unfixed toner image 17 formed on the surface thereof, is conveyed in the direction of arrow P by a non illustrated conveying mechanism. When the recording medium 16 passes through the press contact portion, the unfixed toner image 17 is fixed onto the surface of the recording medium 16 by being heated by the contact with the heated region of the fixing belt 10. Then, the recording medium 16 with the image 18 formed on the surface thereof, is conveyed in the direction of the arrow P by the non illustrated conveying mechanism, and ejected from the fixing device 20. Also, at the press contact portion, when the fixing process has been completed, the specific region of the external peripheral surface of the fixing belt 10 that has been reduced in surface temperature is moved, along with the rotation of the fixing belt 10, to the location of heating by the electromagnetic induction coil 14, and then is re-heated in preparation for the next fixing process.

Here, when fixing is carried out by the fixing belt 10 and the pressing roller 11, when fixing plural recording media 16 that are of a smaller size than the width of the fixing region of the fixing belt 10 (the length in the axial direction) is carried out successively, whereas there is heat consumed for the portion of the fixing belt 10 past which paper passes, there is no heat consumed in the portion past which no paper passes. Therefore the temperature rises in the portion of the fixing belt 10 that has no paper conveyed past.

When the temperature of the portion that has no paper conveyed past reaches the Curie point or higher of the magnetic shunt alloy included in the base layer 10*a*, the region of the base layer 10*a* that is superimposed on (in contact with) the portion of the fixing belt 10 that has no paper conveyed past becomes non magnetic. Due to this, a difference is generated in the magnetic flux density (strength/weakness of the magnetic field) between the paper passing region, which is a region which maintains its magnetism, and the portion that has no paper conveyed past, which is a region that is made non magnetic (paramagnetic), and the generation of heat in the heat generation layer in the non paper passing region becomes less than that in the paper passing region. Therefore, heat generation in the heat generation layer 10*b* of the fixing belt 10 is suppressed by the base layer 10*a*.

The electromagnetic induction coil 14 may be disposed at the external peripheral side of the fixing belt 10, and, whilst the separation between the electromagnetic induction coil 14 and the fixing belt 10 may be selected without any particularly limitations, a non contact separation between the two of 5 mm or less may be provided.

<Image Forming Apparatus>

Next, the image forming apparatus of an aspect of the present invention will be explained.

The image forming apparatus of an aspect of the present invention includes: an image holding member; a charging unit that charges a surface of the image holding member; a latent image forming unit that forms a latent image on the surface of the image holding member; a developing unit that develops as a toner image the formed latent image; a transfer unit that transfers the toner image onto a recording medium; and a fixing unit that heat fixes the toner image onto the recording medium. The fixing unit includes a fixing device of an aspect of the invention.

Figure 4:
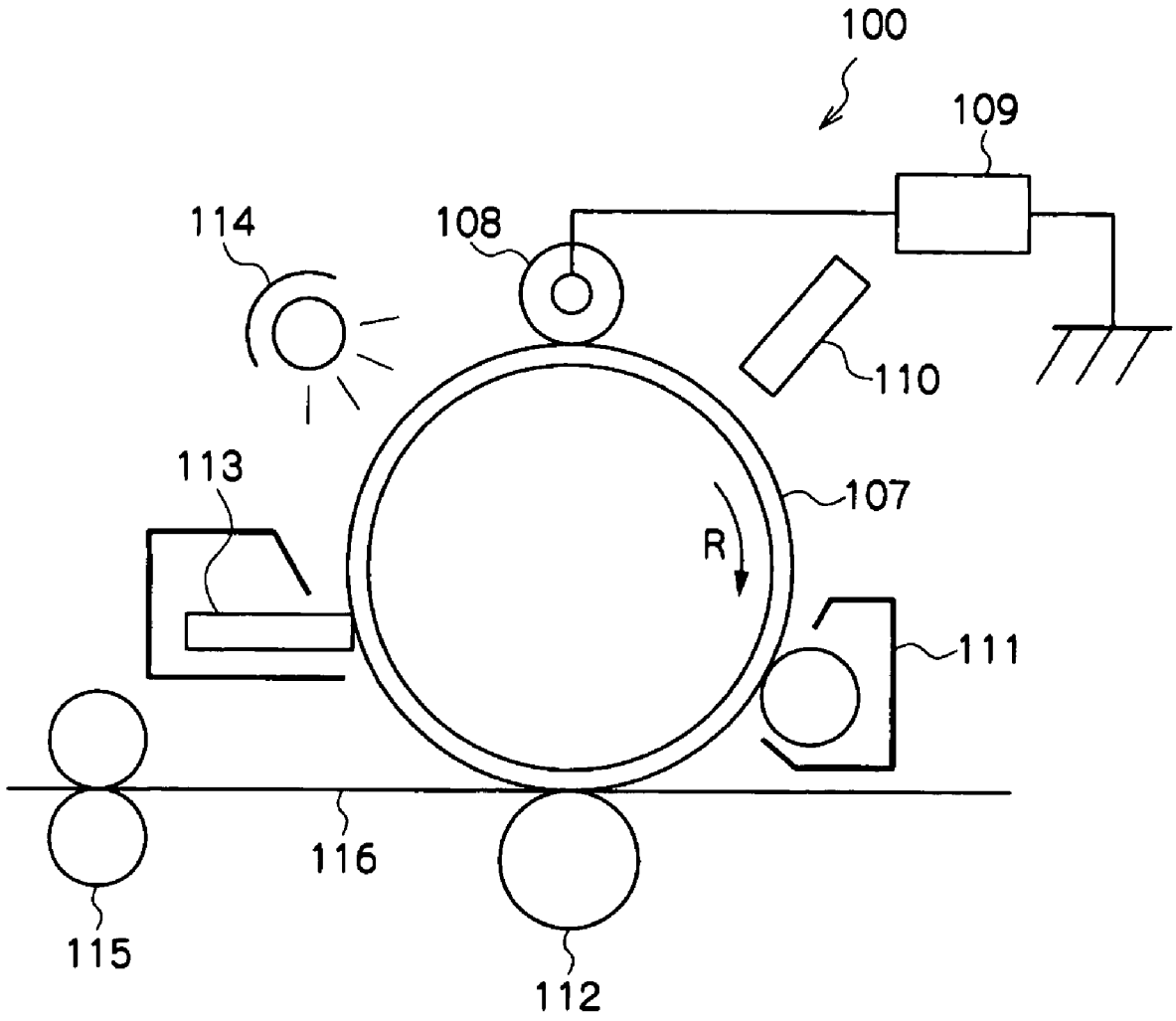
FIG. 4 is a diagram showing an outline configuration of one example of an image forming apparatus of an aspect of the present invention.

FIG. 4 is a diagram showing an outline configuration of one example of the image forming apparatus of an aspect of the present invention. The image forming apparatus 100 shown in FIG. 4, is provided with an electrophotographic photoreceptor (image holding member) 107, a charging device (charging unit) 108 that charges the electrophotographic photoreceptor 107 by a contact charging method, a power source 109 that is connected to the charging device 108 and supplies power to the charging device 108, an exposing device (latent image forming unit) 110 that forms an electrostatic latent image on the surface of the electrophotographic photoreceptor 107 by light-exposure of the surface of the electrophotographic photoreceptor 107 charged by the charging device 108, a developing device (developing unit) 111 that forms a toner image by developing with toner the electrostatic latent image formed by the exposing device 110, a transfer device (transfer unit) 112 that transfers the toner image formed by the developing device 111 to a recoding medium, a cleaning device 113, a charge removal unit 114, and a fixing device (fixing unit) 115

Furthermore, whilst not shown in FIG. 4, there is a toner supply device for supplying toner to the developing device 111.

The charging device 108 is a charging device which contacts a charging roll to the surface of the electrophotographic photoreceptor 107 and applies a voltage to the photoreceptor, charging the surface of the photoreceptor to a specific voltage. When the electrophotographic photoreceptor 107 is charged using the charging roll a biasing voltage for charging is applied to the charging roll, and this applied voltage may be a direct current or a direct current with an alternating current superimposed thereon. The image forming apparatus according to the present exemplary embodiment may use the above charging roll, or may use a charging brush, a charging film or charging tube for carrying out charging by a contact charging method, or may use a corotron or scorotron for carrying out charging by a non contact charging method.

As an exposing device 110, in the present exemplary embodiment a semiconductor laser device is used for exposing the surface of the electrophotographic photoreceptor 107, however, other than this, an optical system device that is able to expose a specific pattern from a light source, such as a LED (light emitting diode) or a liquid crystal shutter, may be used.

General developing units may be used as the developing device 111 that develop, by a contact or non contact method, using a magnetic or non magnetic single component developer or dual component developer. The developing unit is not particularly limited and may be selected according to the purpose.

As the transfer device 112 a roller shaped contact charging member may be used, however, other than this, a belt, film or rubber blade contact transfer device may be used, or a scorotron transfer charging device or a corotron transfer charging device using corona electrical discharge may be used.

The cleaning device 113 is a device for removing toner remnants adhered to the surface of the electrophotographic photoreceptor 107 after the transfer process, and the electrophotographic photoreceptor 107 that has had its surface cleaned in such a manner is operated by carrying out repeated cycles of the above image forming process. As the cleaning device 113, other than the shown blade cleaning type, other methods such as brush cleaning and roll cleaning may be used, however amongst these the blade cleaning method is preferable, and urethane rubber, neoprene rubber, silicone rubber and the like may be given as examples of materials for the cleaning blade.

Next, a simple explanation will be given below of the image forming process in the image forming apparatus 100. The surface of the electrophotographic photoreceptor 107 being rotated in the direction of arrow R is charged by the charging device 108. A latent image is formed on the charged surface of the electrophotographic photoreceptor 107 by irradiation with a laser beam or the like emitted by the exposing device 110 according to the image information. The latent image formed on the surface of the electrophotographic photoreceptor 107 is made visable as a toner image, by the application of toner using a developing unit provided in the developing device 111. The toner image formed on the surface of the electrophotographic photoreceptor 107 by the above method is transferred onto a recording medium 116 by a biasing voltage applied between the electrophotographic photoreceptor 107 and the transfer roll at the press contact portion between the electrophotographic photoreceptor 107 and the transfer device 112. The transferred toner image is conveyed to the fixing device 115 and fixed onto the recording medium 116. The fixing mechanism is as per the above explanation of the fixing device.

The surface of the electrophotographic photoreceptor 107 is cleaned by the cleaning device 113, in preparation for forming a toner image according to the next image information.

Furthermore, the image forming apparatus 100 is, as shown in FIG. 4, provided with a charge removal unit (erasing light irradiation device) 114, and in such a way, when repeated use of the 107 is carried out, an image from remaining potential on the electrophotographic photoreceptor 107 is prevented from being carried over into the next cycle of the image forming process.

EXAMPLES

Explanation will now be given of specific examples of the present invention, however the present invention is not limited to these examples.

Example 1

[Endless Belt Having a Heat Generation Layer/Base Layer]

A Cu metal plate (layer thickness 0.2 mm), for use as the heat generation layer, and a Fe—Ni metal plate (Ni content 36% by weight, Curie point 230° C., layer thickness 0.8 mm), for use as the base layer, with a total thickness of 1.0 mm are prepared, then after polishing the surfaces to be adhered and removing any oxidized film, the respective metal plates are bonded together in a hot rolling process, producing a Cu/Fe—Ni double layer metal plate of overall thickness 0.4 mm. This double layer metal plate is then heat treated in a nitrogen atmosphere at 700° C., and stress due to the working is removed.

Next, the double layer metal plate is molded into a cylinder container shape by a press/deep drawing process, then by a rotary forming method an endless belt of the double layer metal plate is obtained with an internal diameter of 30 mm, a length of 370 mm, a thickness of 50 μm (Cu heat generation layer 10 μm, Fe—Ni base layer 40 μm).

The resistivity value of the heat generation layer is $1.72\times10^{-6}$ Ωm, and the resistivity value of the base layer is $9.7\times10^{-6}$ Ωm.

When the metal endless belt is cross-sectioned in the thickness direction, and the cross-section observed using a microscope (Trade Name: SCANNING ELECTRON MICROSCOPE T-200, manufactured by JEOL Ltd.), crystal particles that are metal crystals aligned in the surface direction may be observed.

[Elastic Layer]

The surface of the heat generation layer of the endless belt is coated with a liquid silicone rubber (Trade Name: KE 1940-35, liquid silicone rubber A35 product; manufactured by Shinetsu Chemical Co., Ltd.) prepared to give a durometer hardness of A35 durometer hardness Type-A, tested according to the durometer hardness test standard as set out in JIS-K6253 (1997) so that a thickness thereof becomes 200 μm, then by drying, a dry state of the liquid silicone rubber layer is provided.

[Release Layer]

The surface of the above dry state liquid silicone rubber layer is coated with a PFA dispersion (Trade Name: 500 CL; manufactured by Du Pont-Mitsui Fluorochemicals Co., Ltd.) so as to produce a layer thickness of 30 μm, and by baking at 380° C. the elastic layer is formed from the silicone rubber and the release layer is formed from the PFA, and the endless belt is obtained.

[Pressing Roll]

A fluororesin tube, of external diameter 50 mm, length 340 mm, and thickness 30 μm, which has been coated on the inside with an adhesive primer, together with a metal central core made from metal, are set in a mold, liquid foam silicone rubber is injected into the space between the fluororesin tube and the core at a layer thickness of 2 mm, then the silicone rubber is vulcanized by heat treatment (at 150° C. for 2 hours) and a pressing roll is produced that has foam rubber elasticity.

<<Evaluation>>

The endless belt is applied as a fixing belt, and the fixing belt and the pressing roll are mounted in an image forming apparatus (Trade Name: DOCU PRINT C620; manufactured by Fuji Xerox Ltd.) provided with a thermal fixing device 20 as shown in FIG. 3. Next, the image forming apparatus is used and the time from switching the power on until achieving the fixing temperature (170° C.) is measured. The result is 5 seconds, and instant-on functionality may be achieved. If the above warm up time is up to 10 seconds then it may be said that a level of instant-on functionality may be achieved that is sufficient in practice.

Next, when 500 sheets of small size paper (JD Paper, B5 size) have been successively passed through, the temperature of the belt is measured at the portion that has had paper conveyed past and at the portion that has not had paper conveyed past, and excessive temperature gain in the portion that has not had paper conveyed past is evaluated. The result is that the temperature in the portion that has had paper conveyed past becomes 172° C. and the temperature becomes 235° C. in the portion that has no paper conveyed past, and excessive raising of the temperature in the portion that has no paper conveyed past may be suppressed. If the temperature is 250° C. or less in the portion that has no paper conveyed past then there is no occurrence of degeneration of the elastic layer or the release layer due to the heat, and it may be said that, in practice, sufficient suppression of excessive temperature gain may be achieved.

Furthermore, evaluation is undertaken of the durability of the fixing belt to maintain the heat generation ability under continuous free rotation, whilst the fixing belt is in a state of being electromagnetic induction heated. The result is that even after 200 hours of free rotation, there is no generation of defects in the heat generation due to generation of cracks or permanent deformation in the heat generation layer, and stable fixing by electromagnetic induction heating may be carry out. It may be said that if the time till generation of defects in heat generation is 100 hours or greater, then, in practice, there is sufficient durability.

Example 2

In the method of manufacturing the endless belt of Example 1, a Ag metal plate (layer thickness 0.16 mm), is selected as the metal plate for use as the heat generation layer, and an Fe—Ni—Co metal plate (Ni content 36% by weight, Co content 5% by weight, Curie point 205° C., layer thickness 0.84 mm) is selected as the metal plate for use as the base layer, and a metal endless belt of a Ag/Fe—Ni—Co double layer is obtained with a thickness of 60 μm (heat generation layer 10 μm, base layer 50 μm) by the same processing method. Further, an elastic layer and a release layer are formed on the surface of this belt, in the same way as in Example 1, and an endless belt is obtained.

The resistivity value of the heat generation layer is $1.67\times10^{-6}$ Ωm, and the resistivity value of the base layer is $9.8\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of the defects in heat generation due to generation of cracks or permanent changes in the heat generation layer, even after rotating for 200 hours, and stable fixing may be carried out using electromagnetic induction heating.

Example 3

In the method of manufacturing the endless belt of Example 1, in addition to the metal plates for the heat generation layer and the base layer, a metal plate for a protective layer is also prepared, a SUS metal plate for the protective layer (layer thickness 0.16 mm), Cu metal plate for the heat generation layer (layer thickness 0.08 mm), and Fe—Ni metal plate (Ni content 36% by weight, Curie point 230° C., layer thickness 0.16 mm) are respectively selected, and a metal endless belt of a SUS/Cu/Fe—Ni triple layer is obtained with a thickness of 50 μm (protective layer 20 μm, heat generation layer 10 μm, base layer 20 μm) by the same processing method. Further, an elastic layer and a release layer are formed on the surface of this belt, in the same way as in Example 1, and an endless belt is obtained.

The resistivity value of the protective layer is $9.7\times10^{-6}$ Ωm, the resistivity value of the heat generation layer is $1.72\times10^{-6}$ Ωm and the resistivity value of the base layer is $9.8\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 6 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 237° C., and excessive temperature gain in the portion that has no paper conveyed past may be suppressed.

Furthermore, in the durability evaluation as of Example 1, there is no generation of heat generation defects due to generation of cracks or permanent changes in the heat generation layer, even after rotating for 200 hours, and stable fixing may be carried out using electromagnetic induction heating.

Example 4

In the method of manufacturing the endless belt of Example 3, as the metal plates for the protective layer, heat generation layer and the base layer, a SUS metal plate (layer thickness 0.145 mm), Al metal plate (layer thickness 0.11 mm), and Fe—Ni—Mn metal plate (Ni content 36% by weight, Mn content 5% by weight, Curie point 210° C., layer thickness 0.145 mm) are respectively selected, and a metal endless belt of a SUS/Al/Fe—Ni—Mn triple layer is obtained with a thickness of 55 μm (protective layer 20 μm, heat generation layer 15 μm, base layer 20 μm) by the same processing method. Further, an elastic layer and a release layer are formed on the surface of this belt, in the same way as in Example 1, and an endless belt is obtained.

The resistivity value of the protective layer is $9.8\times10^{-6}$ Ωm, the resistivity value of the heat generation layer is $2.8\times10^{-6}$ Ωm and the resistivity value of the base layer is $9.9\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 7 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 217° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 5

In the method of manufacturing the endless belt of Example 1, as metal plates for the heat generation layer and the base layer, a Cu metal plate (layer thickness 0.04 mm), and Fe—Ni—Co metal plate (Ni content 36% by weight, Co content 5% by weight, Curie point 205° C., layer thickness 0.36 mm) are respectively selected, and a metal endless belt of a Cu/Fe—Ni—Co double layer is obtained with a thickness of 56 μm (heat generation layer 6 μm, base layer 50 μm) by the same processing method. Further, an elastic layer and a release layer are formed on the surface of this belt, in the same way as in Example 1, and a fixing belt is obtained.

The resistivity value of the heat generation layer is $1.70\times10^{-6}$ Ωm and the resistivity value of the base layer is $9.8\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 6

In the method of manufacturing the endless belt of Example 1, as metal plates for the heat generation layer and the base layer, a Cu metal plate (layer thickness 0.16 mm), and Fe—Ni—Co metal plate (Ni content 36% by weight, Co content 5% by weight, Curie point 205° C., layer thickness 0.24 mm) are respectively selected, and a metal endless belt of a Cu/Fe—Ni—Co double layer is obtained with a thickness of 49 μm (heat generation layer 19 μm, base layer 30 μm) by the same processing method. Further, an elastic layer and a release layer are formed on the surface of this belt, in the same way as in Example 1, and a fixing belt is obtained.

The resistivity value of the heat generation layer is $1.80\times10^{-6}$ Ωm and the resistivity value of the base layer is $9.7\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 7

In the method of manufacturing the endless belt of Example 1, as metal plates for the heat generation layer and the base layer, a Cu metal plate (layer thickness 0.07 mm), and Fe—Ni—Co metal plate (Ni content 36% by weight, Co content 5% by weight, Curie point 205° C., layer thickness 0.33 mm) are respectively selected, and a metal endless belt of a Cu/Fe—Ni—Co double layer is obtained with a thickness of 48 μm (heat generation layer 8 μm, base layer 40 μm) by the same processing method. Further, an elastic layer and a release layer are formed on the surface of this belt, in the same way as in Example 1, and a fixing belt is obtained.

The resistivity value of the heat generation layer is $1.80\times10^{-6}$ Ωm and the resistivity value of the base layer is $9.9\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 8

In the method of manufacturing the endless belt of Example 1, as metal plates for the heat generation layer and the base layer, a Cu metal plate (layer thickness 0.1 mm), and Fe—Ni—Co metal plate (Ni content 36% by weight, Co content 5% by weight, Curie point 205° C., layer thickness 0.3 mm) are respectively selected, and a metal endless belt of a Cu/Fe—Ni—Co double layer is obtained with a thickness of 56 μm (heat generation layer 14 μm, base layer 42 μm) by the same processing method. Further, an elastic layer and a release layer are formed on the surface of this belt, in the same way as in Example 1, and a fixing belt is obtained.

The resistivity value of the heat generation layer is $1.70\times10^{-6}$ Ωm and the resistivity value of the base layer is $9.8\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 9

In the method of manufacturing the endless belt of Example 1, as metal plates for the heat generation layer and the base layer, a Cu metal plate (layer thickness 0.3 mm), and Fe—Ni—Co metal plate (Ni content 36% by weight, Co content 5% by weight, Curie point 205° C., layer thickness 0.37 mm) are respectively selected, and a metal endless belt of a Cu/Fe—Ni—Co double layer is obtained with a thickness of 48 μm (heat generation layer 4 μm, base layer 44 μm) by the same processing method. Further, an elastic layer and a release layer are formed on the surface of this belt, in the same way as in Example 1, and a fixing belt is obtained.

The resistivity value of the heat generation layer is $1.80\times10^{-6}$ Ωm and the resistivity value of the base layer is $9.8\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Example 10

In the method of manufacturing the endless belt of Example 1, as metal plates for the heat generation layer and the base layer, a Cu metal plate (layer thickness 0.13 mm), and Fe—Ni—Co metal plate (Ni content 36% by weight, Co content 5% by weight, Curie point 205° C., layer thickness 0.27 mm) are respectively selected, and a metal endless belt of a Cu/Fe—Ni—Co double layer is obtained with a thickness of 63 μm (heat generation layer 21 μm, base layer 42 μm) by the same processing method. Further, an elastic layer and a release layer are formed on the surface of this belt, in the same way as in Example 1, and a fixing belt is obtained.

The resistivity value of the heat generation layer is $1.80\times10^{-6}$ Ωm and the resistivity value of the base layer is $9.7\times10^{-6}$ Ωm. Furthermore, when a cross-section of the obtained metal endless belt is examined by the method shown in Example 1, crystal particles may be observed in which metal crystals are aligned in the surface direction.

Next, when the warm up time as of Example 1 is measured, the time is 5 seconds and instant-on functionality may be realized.

Further, when evaluation is made of excessive temperature gain as of Example 1 in the portion that has no paper conveyed past, the portion that has paper conveyed past temperature is 172° C. and the portion that has no paper conveyed past temperature is 215° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Comparative Example 1

In the method of manufacturing the endless belt of Example 1, a Fe—Ni metal plate (Ni content 36% by weight, Curie point 230° C., layer thickness 1.2 mm) only is prepared as a metal plate for the heat generation layer, and a metal endless belt of a Fe—Ni single layer is obtained with a thickness of 150 μm by the same processing method. Further, an elastic layer and a release layer are formed on the surface of this belt, in the same way as in Example 1, and an endless belt is obtained.

Next, when the warm up time as of Example 1 is measured, the time is 37 seconds and instant-on functionality cannot be realized.

Further, when evaluation is made of excessive temperature gain as of Example 1 in the portion that has no paper conveyed past, the portion that has paper conveyed past temperature is 171° C. and the portion that has no paper conveyed past temperature is 245° C., and excessive temperature gain in the portion that has no paper conveyed past may be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Comparative Example 2

In the method of manufacturing the endless belt of Example 1, as metal plates for the heat generation layer and the base layer, a Cu metal plate (layer thickness 0.1 mm), and a ferrite-based stainless steel 310 metal plate (layer thickness 0.8 mm) are respectively selected, and a metal endless belt of a Cu/ferrite-based stainless double layer is obtained with a thickness of 45 μm (heat generation layer 5 μm, base layer 40 μm) by the same processing method. Further, an elastic layer and a release layer are formed on the surface of this belt, in the same way as in Example 1, and an endless belt is obtained.

Next, when the warm up time as of Example 1 is measured, the time is 25 seconds and instant-on functionality cannot be realized.

Further, when evaluation is made of excessive temperature gain as of Example 1 in the portion that has no paper conveyed past, the portion that has paper conveyed past temperature is 172° C. and the portion that has no paper conveyed past temperature is 255° C., and excessive temperature gain in the portion that has no paper conveyed past may not be suppressed.

Furthermore, in the durability evaluation as of Example 1, there is no generation of heat generation defects due to generation of cracks in the heat generation layer or permanent changes, even after rotating for 200 hours, and stable fixing may be carried out using electromagnetic induction heating.

Comparative Example 3

An off-the-shelf polyimide precursor liquid (Trade Name: U-VARNISH-S; manufactured by UBE Industries Ltd.) is coated onto the surface of a cylindrical stainless steel mold of external diameter 30 mm, and a coated film is formed. Next, after drying off the solvent in the coated film by drying the coated film for 30 minutes at 100° C., imidization is carried out by baking for 30 minutes at 380° C., and a 60 μm layer thickness polyimide film is formed. After cooling, the polyimide film is removed from the surface of the stainless mold, and a heat resistant body (heat resistant resin layer) is obtained with an internal diameter of 30 mm, a layer thickness of 75 μm, and a length of 370 mm.

Next, a metal layer is formed on the external peripheral surface of the heat resistant body, formed by electroless Cu plating to a thickness of 0.3 μm, and, using this film as an electrode, a 10 μm thick film is formed using copper electroplating. Further, an elastic layer and a release layer are formed, in the same way as in Example 1, and an endless belt is obtained.

Next, when the warm up time as of Example 1 is measured, the time is 23 seconds and instant-on functionality cannot be realized.

Further, when evaluation is made of excessive temperature gain as of Example 1 in the portion that has no paper conveyed past, the portion that has paper conveyed past temperature is 172° C. and the portion that has no paper conveyed past temperature is 255° C., and excessive temperature gain in the portion that has no paper conveyed past may not be suppressed.

Furthermore, in the durability evaluation as of Example 1, there is generation of cracks in the heat generation layer, and defects of heat generation defects after rotating for 50 hours.

Exemplary embodiments of the present invention are shown below, but the invention is not limited by these exemplary embodiments.

<1> The laminated body of an aspect of the invention includes a heat generation layer that includes crystalline particles of a non-magnetic metal; and a base layer that includes a magnetic shunt alloy.

<2> In the laminated body of <1>, the thickness of the heat generation layer may be from 5 μm to 20 μm.

<3> In the laminated body of <1>, the thickness of the heat generation layer may be from 7 μm to 15 μm.

<4> In the laminated body of <1>, the thickness of the heat generation layer may be from 8 μm to 12 μm.

<5> In the laminated body of any one of <1> to <4>, the crystalline particles may be aligned along the surface direction of the heat generation layer.

<6> In the laminated body of any one of <1> to <5>, the heat generation layer may have a resistivity value of $2.8\times10^{-6}$ μm or below.

<7> In the laminated body of any one of <1> to <5>, the heat generation layer may have a resistivity value from $1.0\times10^{-6}$ μm to $2.5\times10^{-6}$ Ωm.

<8> In the laminated body of any one of <1> to <5>, the heat generation layer may have a resistivity value from $1.2\times10^{-6}$ μm to $2.2\times10^{-6}$ Ωm.

<9> In the laminated body of any one of <1> to <8>, the non-magnetic metal may include at least one selected from the group consisting of gold, silver, copper, aluminum and an alloy thereof.

<10> In the laminated body of any one of <1> to <9>, the base layer may have a resistivity value higher than $2.8\times10^{-6}$ Ωm.

<11> In the laminated body of any one of <1> to <9>, the base layer may have a resistivity value from $5.0\times10^{-6}$ Ωm to $5.0\times10^{-5}$ Ωm.

<12> In the laminated body of any one of <1> to <9>, the base layer may have a resistivity value from $7.0\times10^{-6}$ Ωm to $3.0\times10^{-5}$ Ωm.

<13> In the laminated body of any one of <1> to <12>, the magnetic shunt alloy may include at least one selected from the group consisting of iron, nickel, chromium, cobalt, molybdenum, manganese, vanadium and an alloy thereof <14> In the laminated body of any one of <1> to <13>, the heat generation layer and the base layer may be formed using plastic deformation.

<15> The laminated body of any one of <1> to <14> may include a protective layer including a non-magnetic metal (second non-magnetic metal) different from the non-magnetic metal (first non-magnetic metal) used in the heat generation layer, on or above the heat generation layer on the side opposite to the side on which the base layer is formed.

<16> In the laminated body of <15>, the protective layer may be formed using plastic deformation.

<17> The laminated body of any one of <1> to <16> may include an elastic layer on or above the heat generation layer on the side opposite to the side on which the base layer is formed.

<18> The laminated body of any one of <1> to <17> may include a resin layer on or above the heat generation layer on the side opposite to the side on which the base layer is formed.

<19> In the laminated body of any one of <1> to <18>, the neutral axis may be located within the heat generation layer so that when bending deformation occurs, there is no stress generated therein.

<20> An endless belt of an aspect of the invention includes the laminated body of any one of <1> to <19> formed into an endless shape.

<21> A fixing device of an aspect of the invention includes the endless belt of <20>; a pressing member that presses the external peripheral face of the endless belt; and a heat generation member that causes generation of heat in the heat generation layer of the endless belt using electromagnetic induction.

<22> In the fixing device <21>, the heat generation member may be provided at the external peripheral face side of the endless belt.

<23> An image forming apparatus including: an image holding member; a charging unit that charges a surface of the image holding member; a latent image forming unit that forms a latent image on the surface of the image holding member; a developing unit that develops as a toner image the formed latent image; a transfer unit that transfers the toner image onto a recording medium; and a fixing unit that fixes the toner image onto the recording medium, the fixing unit including the fixing device of <21> or <22>.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A laminated body comprising:

a heat generation layer that includes crystalline particles of a non-magnetic metal; and a base layer that includes a magnetic shunt alloy, wherein the heat generation layer has a resistivity value from about $1.0\times10^{-6}$ Ωm to about $2.5\times10^{-6}$ Ωm.

2. The laminated body of claim 1, wherein the thickness of the heat generation layer is from about 5 μm to about 20 μm.

3. The laminated body of claim 1, wherein the thickness of the heat generation layer is from about 7 μm to about 15 μm.

4. The laminated body of claim 1, wherein the thickness of the heat generation layer is from about 8 μm to about 12 μm.

5. The laminated body of claim 1, wherein the crystalline particles are aligned along the surface direction of the heat generation layer.

6. The laminated body of claim 1, wherein the heat generation layer has a resistivity value from about $1.2\times10^{-6}$ Ωm to about $2.2\times10^{-6}$ Ωm.

7. The laminated body of claim 1, wherein the non-magnetic metal comprises at least one selected from the group consisting of gold, silver, copper, aluminum and an alloy thereof.

8. The laminated body of claim 1, wherein the base layer has a resistivity value higher than about $2.8\times10^{-6}$ Ωm.

9. The laminated body of claim 1, wherein the base layer has a resistivity value of from about $5.0\times10^{-6}$ Ωm to about $5.0\times10^{-5}$ Ωm.

10. The laminated body of claim 1, wherein the base layer has a resistivity value of from about $7.0\times10^{-6}$ Ωm to about $3.0\times10^{-5}$ Ωm.

11. The laminated body of claim 1, wherein the magnetic shunt alloy comprises at least one selected from the group consisting of iron, nickel, chromium, cobalt, molybdenum, manganese, vanadium and an alloy thereof.

12. The laminated body of claim 1, wherein the heat generation layer and the base layer are formed using plastic deformation.

13. The laminated body of claim 1, further comprising a protective layer including a non-magnetic metal (second non-magnetic metal) different from the non-magnetic metal (first non-magnetic metal) used in the heat generation layer, on or above the heat generation layer on the side opposite to the side on which the base layer is formed.

14. The laminated body of claim 13, wherein the protective layer is formed using plastic deformation.

15. The laminated body of claim 1, further comprising, on or above the heat generation layer on the side opposite to the side on which the base layer is formed, at least one layer selected from the group consisting of an elastic layer and a resin layer.

16. An endless belt comprising the laminated body of claim 1 formed into an endless shape.

17. A fixing device comprising:

the endless belt of claim 16 a pressing member that presses the external peripheral face of the endless belt; and a heat generation member that causes generation of heat in the heat generation layer of the endless belt using electromagnetic induction.

18. The fixing device of claim 17, wherein the heat generation member is provided at the external peripheral face side of the endless belt.

19. An image forming apparatus comprising:

an image holding member;

a charging unit that charges a surface of the image holding member;

a latent image forming unit that forms a latent image on the surface of the image holding member;

a developing unit that develops as a toner image the formed latent image;

a transfer unit that transfers the toner image onto a recording medium; and a fixing unit that fixes the toner image onto the recording medium, the fixing unit including the fixing device of claim 17.

* * * * *